United States Patent [19]

Goldberg

[11] Patent Number: 4,742,273

[45] Date of Patent: May 3, 1988

[54] LONG LIFE INCANDESCENT LAMP

[76] Inventor: Herbert E. Goldberg, 195 Heath's Bridge Rd., Concord, Mass. 01742

[21] Appl. No.: 888,391

[22] Filed: Jul. 23, 1986

[51] Int. Cl.[4] ..... H01J 7/44

[52] U.S. Cl. ..... 315/65; 315/66; 315/73; 315/64; 315/112; 337/16; 337/85; 337/87

[58] Field of Search ..... 315/64, 65, 66, 73, 315/74, 75, 93, 119, 362, 159, 185 R; 313/236, 316; 337/16, 85–87

[56] References Cited

U.S. PATENT DOCUMENTS

| | | | |
|---|---|---|---|
| 4,093,894 | 6/1978 | Leighton | 315/64 |
| 4,382,209 | 5/1983 | Loucaides | 315/65 |
| 4,447,760 | 5/1984 | Koo | 315/65 |
| 4,580,079 | 4/1986 | Koo | 315/65 |

*Primary Examiner*—David K. Moore
*Assistant Examiner*—Mark R. Powell

[57] ABSTRACT

An extended life incandescent lamp which employs thermal, voltage, or radiation activated differential switching to substitute a series-connected reserve filament for an inoperative primary filament without increasing the normal in-rush current.

5 Claims, 1 Drawing Sheet

LONG LIFE INCANDESCENT LAMP

SUMMARY OF THE INVENTION

This invention is directed to an improved, long life, incandescent lamp employing a differential switch assembly to substitute a reserve filament for a burned out primary filament without increasing the normal in-rush current.

The invention is illustrated by way of example in the following drawings, where FIGS. 1*a* and 1*b* illustrate a series circuit according to the invention with current flow shown before burn-out (FIG. 1*a*), and after burn-out (FIG. 1*b*), of the primary filament.

FIG. 3 illustrates another way of carrying out the invention.

Although employing three rather than one or two electrical contacts, this circuit reduces in-rush current to both filaments substantially below normal, and thus extends bulb life further.

The design of extended life, high efficiency incandescent light bulbs has been approached in many ways, e.g., gas-filled bulbs, quartz-iodine bulbs and multi-filament bulbs. The latter type may well be the most efficient solution for purposes of general illumination and signaling, but so far it has not been successful commercially because of complications associated with the designs proposed heretofore. It is the purpose of the present invention to furnish a very simple, commercially acceptable solution to the problem.

In order to prolong light bulb life it has been proposed in U.S. Pat. No. 2,448,493 to employ a primary filament and a reserve filament, connected in parallel in a single envelope. Both filaments would light up as power is applied, then the reserve filament is disconnected from the circuit by a thermo-motive switch which opens in response to radiation received from the primary filament. This cycle repeats every time power is applied, so the primary filament supplies all steady state light until it burns out. After that the thermo-motive switch will remain closed and the reserve filament will take over.

Although simple, this idea was not practical because the double in-rush current drawn by both filaments shortens the life of the reserve filament and, more importantly, can easily overload the power supply.

The defect may be corrected in at least two ways:

(A) Power should be applied to the reserve filament only after the primary filament has failed. Suitable circuits for this should follow an analogy with the common problem of lamp replacement, to wit, that lamps are replaced only if they fail to light while voltage is present at the terminals. According to the invention, differential switching is used to connect the reserve filament whenever, and only whenever, this condition obtains.

(B) A series resistor is employed initially to limit the in-rush current and is short circuited after either the primary filament or the reserve filament has lit up.

Figure 1A:
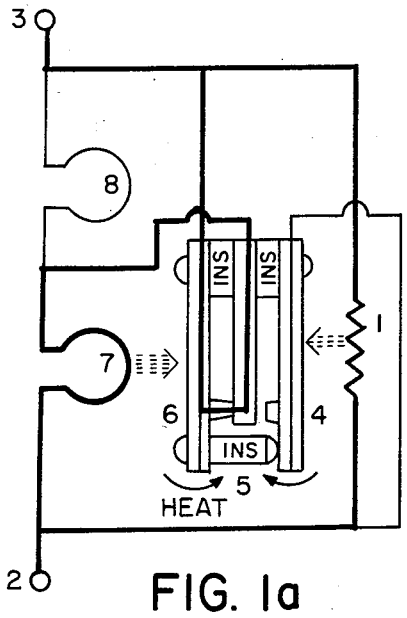

Referring to FIGS. 1*a,b* and 2 in a general way, it is seen that both include a switch assembly which employs two thermo-motive sensors, located respectively on the left and right sides of the switch assembly. The left sensor is designed to establish presence or absence of current flow by sensing radiation from the primary filament. The right sensor is employed to test for presence or absence of voltage at the lamp terminals by responding to the heat generated by a resistor connected to them. An interconnection between the two sensors is designed to assure that the reserve filament is powered if, and only if, terminal voltage is present and primary filament current is absent.

It should be understood that the presence of radiation is only one way of verifying current flow through the primary filament. This can be established in other ways, for instance by sensing current flow through the filament support wires.

Although thermo-motive sensors are used in the present examples, it should also be understood that electrical sensors for current or voltage may be substituted, and solid state devices may be employed to connect the reserve filament at the appropriate time.

Turning now to FIG. 1*a*, Resistor 1 is connected to Terminals 2 and 3 of the circuit. It will radiate or conduct heat to the normally open first thermo-motive Switch 4 whenever voltage is present at the terminals, and thereby urge Switch 4 to close. Closure may be prevented, however, by Spacer 5, which is positioned between thermo-motive Switch 4 and a second thermo-motive Switch 6 which receives radiation whenever Primary Filament 7 conducts current. The force generated by Switch 6 is of sufficient magnitude to prevail over Switch 4 as long as Primary Filament 7 emits radiation. Under these conditions current will flow through Resistor 1, as well as through the closed Switch 6 and the Primary Filament 7. The Reserve Filament 8 is short circuited by Switch 6 and does not light up.

Figure 1B:
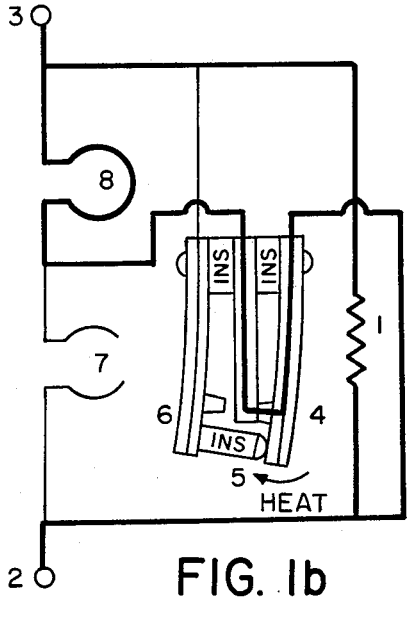

FIG. 1*b* shows the current flow after burn-out of the Primary Filament 7. Switch 6 is then no longer heated and thermo-motive Switch 4 will prevail and will close. It will also open Switch 6 by acting through Spacer 5 and thereby lift the short circuit of the Reserve Filament 8 and allow it to light up.

Figure 2:
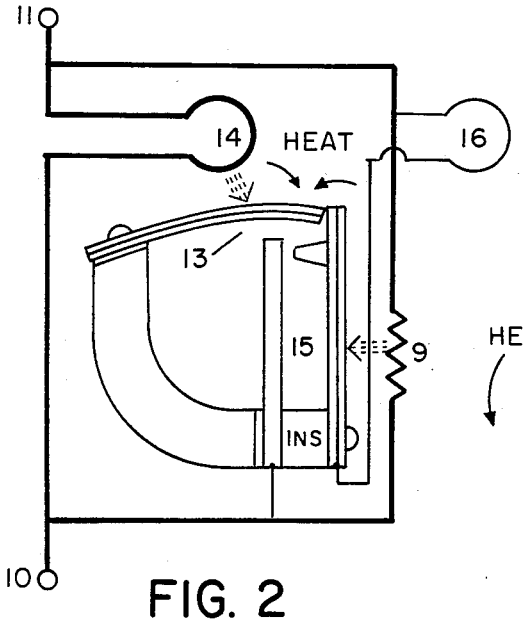
FIGS. 2 and 3 show parallel circuits according to the invention, with FIG. 2 showing an alternate type of differential switch.
Figure 3:
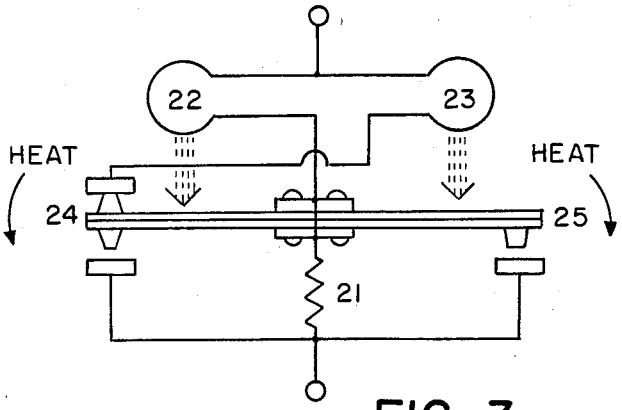

Other embodiments of the invention are illustrated in FIGS. 2 and 3. The two filaments are now arranged in parallel rather than in series, and in FIG. 2 the number of electrical contacts has been reduced from two to one. The differential swich shown in this figure makes use of an interfering, rather than a restraining, member. It should be understood, however, that either a restraining or an interfering member may be employed to construct differential switches for use in the circuits of FIGS. 1*a,b* and 2, depending on space available.

FIG. 2 shows the flow of current before burn-out of the primary filament. Just as explained above, there is a Resistor 9 connected between Terminals 10 and 11. It serves to radiate or conduct heat to the thermo-motive Switch 15 to verify that sufficient voltage is present at the lamp terminals. Switch 15 is designed to be normally open, and closure is prevented as explained above (FIGS. 1*a,b*) or, alternately, as shown in FIG. 2 where an Interfering Member 13 will prevail over thermo-motive Switch 15 and prevent it from closing as long as Primary Filament 14 conducts current and thereby emits radiation. The Interfering Member 13 is designed to respond to radiation from the primary filament more rapidly than the thermo-motive Switch 15 can respond to heat from Resistor 9.

After burn-out of the Primary Filament 14, Switch 15 will close and will direct current through the Reserve Filament 16 to Terminal 11.

FIG. 3 illustrates a circuit designed to function according to Method B discussed above.

A current limiting Resistor 21 is placed in series with both the Primary Filament 22 and the Reserve Filament 23. As power is applied, the double throw thermo-motive Switch 24 responds to radiation received from the Primary Filament 22, disconnecting the Reserve Filament 23, and then short circuiting the current limiting Resistor 21. This thermo-motive Switch 24 is designed to respond more rapidly to radiation from Primary Filament 22 than a second thermo-motive Switch 25 responds to radiation from Reserve Filament 23. Switch 24 disconnects Reserve Filament 23 and thereby prevents Switch 25 from closing during this cycle.

After burn-out of the Primary Filament 22, it no longer conducts current and the thermo-motive Switch 24 receives no further radiation and reverts to its initial position. This opens the short of Resistor 21 and applies limited current to the Reserve Filament 23. Switch 25 will then receive radiation, close, and short Resistor 21 once more and thereby allow full current to flow through the Reserve Filament 23.

Having thus described my invention, what I claim is:

1. A long life incandescent bulb switch comprising:

terminals connectable to a source of power to supply power to a primary filament and a reserve filament when connected in series across said terminals, first sensing means operative to sense the presence or absence of voltage across said terminals, second sensing means operative to sense the presence or absence of current through said primary filament, switching means comprising a first, normally open shunt across said primary filament and a second, normally closed shunt across said reserve filament, said switching means responsive to said first and second sensing means and operative to close said first shunt and open said second shunt only when voltage is present at said terminals and current is absent through said primary filament; whereby the reserve filament is energized only upon failure of the primary filament.

2. A long life incandescent bulb switch according to claim 1, said first sensing means and said second sensing means comprising first and second thermomotive means respectively, said first thermomotive means having a first time of response to the presence of said voltage, said second thermomotive means having a second time of response to the presence of said current, said second time of response being shorter than said first time of response, and said second thermomotive means being operative to prevent said first thermomotive means from responding to the presence of said voltage whenever said current is present through said primary filament.

3. A long life incandescent bulb switch comprising:

terminals connectable to a source of power to supply power to a primary filament when connected across said terminals, and to a reserve filament and normally open switching means connected in series across said primary filament to form a normally open shunt across said primary filament, first sensing means operative to sense the presence or absence of voltage across said terminals, second sensing means operative to sense the presence or absence of current through said primary filament, said switching means responsive to said first and second sensing means and operative to close said shunt only when voltage is present at said terminals and current is absent through said primary filament; whereby said reserve filament is energized only upon failure of said primary filament.

4. A long life incandescent bulb switch according to claim 3, said first sensing means and said second sensing means comprising first and second thermomotive means respectively, said first thermomotive means having a first time of response to the presence of said voltage, said second thermomotive means having a second time of response to the presence of said current, said second time of response being shorter than said first time of response, and said second thermomotive means being operative to prevent said first thermomotive means from responding to the presence of said voltage whenever said current is present through said primary filament.

5. A long life incandescent bulb switch comprising:

terminals connectable to a source of power to supply power to a primary filament and current limiting means when connected in series across said terminals, and to a reserve filament when connected to first switching means, said first switching means comprising a normally closed switch connected in series with said reserve filament across said primary filament and a first, normally open shunt across said current limiting means, second switching means forming a second, normally open shunt across said current limiting means, first sensing means to sense the presence or absence of current through said primary filament, second sensing means to sense the presence or absence of current through said reserve filament, said first switching means being responsive to said first sensing means and operative to open said normally closed switch and to close said first shunt only when current is present through said primary filament, said second switching means being responsive to said second sensing means and operative to close said second shunt only when current is present through said reserve filament, said first sensing means operative to respond more rapidly than said second sensing means; whereby said reserve filament is fully energized only upon failure of said primary filament.

* * * * *